US005200372A

United States Patent [19]

Kuroyama et al.

[11] Patent Number: 5,200,372

[45] Date of Patent: Apr. 6, 1993

[54] METHOD FOR PRODUCTION OF HIGH-PRESSURE PHASE SINTERED ARTICLE OF BORON NITRIDE FOR USE IN CUTTING TOOL AND SINTERED ARTICLE PRODUCED BY THE METHOD

[75] Inventors: Yutaka Kuroyama, Aichi; Nasami Maeno, Handa, both of Japan

[73] Assignee: Nippon Oil & Fats Co., Ltd., Tokyo, Japan

[21] Appl. No.: 635,985

[22] Filed: Dec. 31, 1990

[30] Foreign Application Priority Data

Jan. 12, 1990 [JP] Japan ..... 2-3336

[51] Int. Cl.[5] ..... C04B 35/56; C04B 35/58

[52] U.S. Cl. ..... 501/96; 501/98; 423/290; 423/351; 423/353

[58] Field of Search ..... 501/96, 98, 93, 87, 501/97; 423/290, 357, 353

[56] References Cited

U.S. PATENT DOCUMENTS 4,375,517 3/1983 Watanabe et al. ..... 501/93 X
4,788,166 11/1988 Araki et al. .
5,041,399 8/1991 Fukay et al. ..... 501/96 X

*Primary Examiner*—Mark L. Bell
*Assistant Examiner*—Alan Wright
*Attorney, Agent, or Firm*—Oblon, Spivak, McClelland, Maier & Neustadt

[57] ABSTRACT

A sintered article is produced by mixing an intermetallic compound (binding phase) composed of at least one member selected from among carbides, nitrides, and borides of the elements of Groups 4a, 5a, and 6a in the Periodic Table of Elements and at least one element selected from among Al, Ni, Si, Co, Zr, and W with wBN, then mixing the resultant mixture with cBN and firing the produced mixture under a pressure exceeding 20 Kb at a temperature exceeding 1,000° C. As a material for cutting tools, the sintered article is superior in quality to the conventional sintered article.

5 Claims, 6 Drawing Sheets

METHOD FOR PRODUCTION OF HIGH-PRESSURE PHASE SINTERED ARTICLE OF BORON NITRIDE FOR USE IN CUTTING TOOL AND SINTERED ARTICLE PRODUCED BY THE METHOD

BACKGROUND OF THE INVENTION

1. Field of the Invention

This invention relates to a cutting tool quality sintered article containing a high-pressure phase boron nitride second only to diamond in hardness and a method for the production of this sintered article.

The sintered article according with the present invention is suitable as a material for tools used for cutting quenched steel materials and other materials that resist cutting.

High-pressure phase boron nitride exists in two types: single crystal cubic boron nitride (hereinafter referred to as "cBN") which is synthesized under an ultra high static pressure above 50 Kb and temperature of 1,200° C. with use of a catalyst and polycrystalline wurtzite type boron nitride (hereinafter referred to as "wBN") which is synthesized under an ultra high static pressure over 100 Kb without use of a catalyst or under an ultra high shock pressure produced by the explosion of a powerful explosive. Both types of high-pressure phase boron nitride possess hardness second only to that of diamond and are useful as raw materials for the production a sintered article for use in a cutting tool capable of grinding, shaving, and cutting metals, particularly iron type metals.

Diamond sintered tools possess high hardness and are outstanding as cutting tools. However, they have the disadvantage that they reacts with iron type metals at elevated temperatures. They are therefore not suitable for cutting iron type materials.

2. Description of the Prior Art

At present, cermet, ceramics, cemented carbide, wBN, and cBN or cBN-wBN sintered articles are used for cutting iron type materials. For high-speed and high-accuracy machining of such hard-to-cut materials as high-hardness quenched materials and Hastelloy materials, the cBN sintered article or the cBN-wBN sintered article, a substance capable of compensating for the drawback of cBN, proves to be particularly suitable.

This invention is directed to a sintered article having cBN-wBN as a main component thereof.

Concerning sintered articles having cBN and wBN as main components, various techniques have been published as follows.

Japanese Patent Publication SHO 52(1977)-19208 discloses a sintered article having grown cBN dispersed in a matrix of wBN and states to the effect that the particles of wBN most desirably measure 0.5 to 10 μm in diameter. Japanese Patent Publication SHO 60(1985)-6306 discloses a sintered article formed of a solid solution comprising a high-pressure phase boron nitride of wBN or cBN transformed from wBN during the process of sintering and M[C, O], M[N, O], and M[C, N, O] and states to the effect that in the sintered article, the wBN accounts for not less than 10% by volume and has a particle size of not more than 10 μm. In the foregoing statement, the symbol M stands for a metal of Group 4a or 5a in the Periodic Table of Elements. Japanese Patent Public Disclosure SHO 55(1980)-97448 discloses a sintered article formed of a mixture of cBN and wBN and containing not less than 10% by volume of wBN. Japanese Patent Public Disclosure SHO 56(1981)-77359 discloses a sintered article formed of a mixture consisting of wBN and cBN wherein the wBN particles are 1 to 1.5 μm in diameter and are contained in the high-pressure phase boron nitride in a concentration of 96–84% by volume. Japanese Patent Public Disclosure SHO 55(1980)-161046 discloses a sintered article produced by sintering a mixture of 1 to 40% by volume of wBN, ceramic, and a metal and consequently enables formation of a reticular structure consisting of cBN transformed from wBN, untransformed wBN, and the metal.

Japanese Patent Public Disclosure SHO 59(1984)-64737 discloses a sintered article of a mixture consisting of 60 to 95% by volume of cBN and 40 to 5% by volume of wBN wherein the cBN has an average particle diameter not less than 5 times the average particle diameter of the wBN. Japanese Patent Public Disclosure HEI 1(1989)-11939 discloses a sintered article containing 30 to 80% by volume of a high-pressure phase boron nitride which consists of 60 to 95% by volume of cBN having an average particle diameter of not more than 15 μm and 5 to 40% by volume of wBN having an average particle diameter of not more than 5 μm.

However, these sintered articles have the following problems.

The sintered articles disclosed in Japanese Patent Publications SHO 52(1977)-19208 and SHO 60(1985)-6306 and Japanese Patent Public Disclosures SHO 55(1980)-97448 and SHO 55(1980)-161046 all contain cBN which has been transformed from wBN. cBN of this nature causes problems regarding cutting tool performance. Moreover, the relation between the particle diameters of the cBN and the wBN, which bears heavily on the performance of cutting tool, is disclosed nowhere in these patent publications.

The sintered article disclosed in Japanese Patent Publication SHO 56(1981)-77359 is deficient in resistance to chipping and poor in cutting property because the wBN content of the high-pressure phase boron nitride is large. The sintered article disclosed in Japanese Patent Public Disclosure SHO 59(1984)-64737 manifests unreliable strength when used in a cutting tool because the cBN particles are unduly large and the wBN content is unduly high.

The sintered article disclosed in Japanese Patent Public Disclosure HEI 1(1989)-11939 has a problem regarding surface roughness because the cBN particles have a large average particle diameter in the range of 5 to 15 μm and also a problem regarding resistance to chipping because the wBN particles have a relatively small diameter not exceeding 5 μm and account for an unduly large proportion to the high-pressure phase boron nitride.

The sintered article of this invention consists of cBN, wBN, and a binding phase. Generally, cBN and wBN individually possess the following characteristics.

As described in the glossary of papers presented at the 1987 autumn general meeting of the Precision Engineering Society [Shinzo Enomoto, Masanori Kato, and Shinichi Miyazawa, "Cutting of iron type metal with cBN cutting tool (particularly the effects of particle diameter and content of cBN)," pages 649 to 650], cBN particles gain in binding force with the binding material in the sintered article and become less apt to separate from the sintered article so as to enable fabrication of a cutting tool with long service life when they have a large particle size and the cutting tool using cBN particles produces the most desirable finished surface roughness when the cBN particles have a very fine size.

The cBN particles have high cutting property because they possess sharp corners. They do not cleave but tend to chip because they comprise single crystals. The roughness of the finished surface is degraded in proportion as the diameter of the cBN particles used for the cutting tool is increased. wBN is a powder which is formed by the aggregation of primary particles, i.e. minute crystals some tens of nm in diameter. It, therefore, manifests a low cutting property, lacks cleaving property, and enjoys high toughness. Since the wBN particles have an extremely small size, they have the advantage of forming on a given work blank a finished surface of highly satisfactory roughness.

SUMMARY OF THE INVENTION

The quality which the sintered article for use in the cutting tool is required to possess is as follows. The sintered article should possess such quality that the cutting tool formed of the sintered article gives to the work blank a cut surface of highly satisfactory roughness, forms a finished surface of accurate dimensions, suffers little occurrence of surface flaws, has a long service life without sustaining appreciable wear, and exhibits high hardness.

The sintered article of this invention is composed of a high-pressure phase boron nitride and a binding phase. The raw materials for the sintered article preferably consist of particles which are fine and uniform in size. When the raw materials answer this description, the particles undergo no abnormal growth during the sintering but preclude occurrence of defects in the sintered article. The sintered article, therefore, readily assumes a high density texture.

For the production of a sintered article for a cutting tool possessing a desired quality by the method of this invention, the most important task resides in fixing the conditions for ideal dispersion of the high-pressure phase boron nitride and the binding phase.

As the result of various studies, the present inventors have reached the conclusion that the object of the invention can be accomplished by using starting raw materials which possess particle sizes falling in specified ranges. This invention has been perfected on the basis of this finding.

To be specific, this invention is directed to a method for the production of a sintered article of high-pressure phase boron nitride for use in cutting tools, which method comprises mixing wurtzite type boron nitride particles of a maximum diameter of 1 μm with an intermetallic compound formed between at least one inorganic compound selected from the group consisting of (a) at least one compound of carbides, nitrides, and borides severally of the elements of Group 4a (Ti, Zr, and Hf), Group 5a (V, Nb, and Ta), and Group 6a (Cr, Mo, and W) in the Periodic Table of Elements and (b) a mutual solid solution of said compounds and at at least one member selected from the group consisting of Al, Ni, Si, Co, Zr, and W, further mixing less than 5 μm particles of cubic boron nitride with the resultant mixture and sintering the produced mixture under a pressure of at least 20 Kb at a temperature of at least 1,000° C. and to a sintered article of high-pressure phase boron nitride for use in cutting tools, produced by the method described above and comprising (1) 10 to 80% by volume of high-pressure phase boron nitride consisting of 95 to 99.9% by volume of the cubic boron nitride and 0.1 to 5% by volume of the wurtzite boron nitride and (2) 20 to 90% by volume of the intermetallic compound.

The above and other objects and features of the invention will become apparent from the following detailed description with reference to the accompanying drawings.

DETAILED DESCRIPTION OF THE PREFERRED EMBODIMENTS

Figure 1:
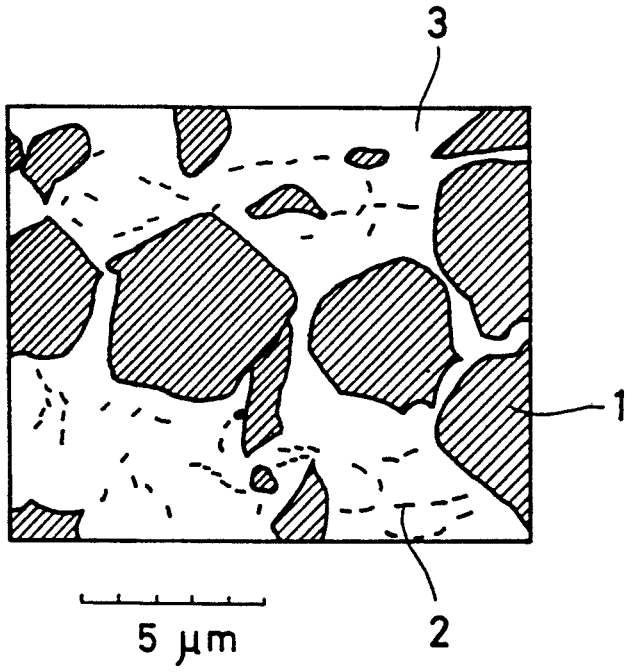
FIG. 1 is a textural diagram based on a 1,500-magnification photomicrograph of a sintered article of the present invention.

The sintered article of this invention has wBN and cBN as main components thereof and further incorporates therein an intermetallic compound between an inorganic compound and a metal. The intermetallic compound serves as a binding phase in the sintered article.

The inorganic compound may be at least one member or a mixture or mutual solid solution of two or more members selected from among the aforementioned carbides, nitrides, and borides.

In the sintered article of the present invention, the high-pressure phase boron nitride consists of 95 to 99.9% by volume of cubic boron nitride and 0.1 to 5% by volume of wurtzite type boron nitride.

If the proportion of the high-pressure phase boron nitride cBN in the sintered article of this invention exceeds 99.9% by volume, the cutting tool formed of the sintered article cuts well but is inadequate in wearproofness. If the proportion of wBN exceeds 5% by volume, the cutting tool is extremely liable to chip. This is thought to be because deviation of these content ratios from the specified ranges hinders the dispersion of finely divided wBN.

Most desirably, the cBN particles have a diameter of less than 5 μm. If their diameter exceeds this upper limit, though the sintered article manifests high strength, the cutting tool formed of the sintered article is deficient in cutting precision and coarse of cut surface. Desirably, the particle diameter of cBN is in the range of 1 to 5 μm. wBN is inferior in particle strength to cBN which consists of single crystals and has no cleaving property because it contains an aggregate of minute crystals of some tens of nm as primary particles.

By having wBN particles of a small diameter uniformly dispersed, there can be obtained a sintered article which manifests high resistance to chipping, is capable of producing a rough finished surface, and enables a work blank to be machined with high precision. Desirably in this invention, the wBN particles have diameters not exceeding 1 μm. If the diameters exceed this upper limit, the low-strength polycrystalline wBN particles cannot easily be dispersed in the desired pattern and chipping resistance becomes insufficient.

The high-pressure phase boron nitride is characterized by exhibiting high hardness and high thermoconductivity. These characteristics are highly desirable in a cutting tool. Since cutting is a phenomenon of plastic deformation manifested on a work blank, high hardness is the primary requirement of the cutting tool. High thermoconductivity helps to reduce accumulation of heat in the tip of cutting tool and prolongs the service life of the cutting tool. To be suitable for a cutting tool the sintered article of high-pressure phase boron nitride is therefore required to rely on a binding phase which can make full use of the outstanding characteristic mentioned above.

The compounds which exhibit high hardness and high thermoconductivity and satisfy the requirement mentioned above are carbides, nitrides, and borides of the elements of Groups 4a, 5a, and 6a in the Periodic Table of Elements and mixtures or mutual solid solutions thereof. For example, such ceramic substances as titanium nitride, titanium carbide, zirconium nitride, tantalum carbide, and titanium boride prove to be exceptionally desirable.

If the binding phase is formed solely of the ceramic substance mentioned above, the cutting tool formed of the sintered article using this binding phase is deficient in toughness, liable to chip, and brittle. It has been found that this drawback is can be eliminated by using as the binding phase an intermetallic compound between a specific metal and a ceramic substance. The metals which are useful for this intermetallic compound are Al, Co, Ni, Si, Zr, and W. One or more of these metals may be caused to react with the ceramic substance or may be allowed to occur during the course of sintering. The selection of the one or more metals should be made based on the temperature which the cutting tool formed of the produced sintering article is expected to be exposed to.

In the present invention, the proportion of the binding phase to the sintered article is in the range of 20 to 90% by volume. The proportion of the one member or a mixture or mutual solid solution of two or more members selected from among the carbides, nitrides, and borides of the elements of Groups 4a (Ti, Zr, Hf), 5a (V, Nb, Ta), and 6a (Cr, Mo, W) in the Periodic Table of Elements in the binding phase is generally in the range of 99.9 to 50% by volume. The proportion of the metal, therefore, is generally in the range of 0.1 to 50% by volume. Preferably the proportion of the metal is in the range of 5 to 40% by volume. If the proportion of the metal is unduly small, the cutting tool formed of the sintered article tends to be deficient in toughness. If the proportion is unduly large, the cutting tool tends to soften at elevated temperatures.

The cutting tool acquires increased tip strength and enhanced resistance to chipping when the cBN content is increased. It acquires increased wearproofness when the cBN content is decreased to a level falling in a specific desirable range. In the case of an increased cBN content, the tip strength increases because of the occurrence of a cBN-cBN bond. The enhanced wearproofness in the case of a decreased cBN content results from the fact that dispersion becomes one in which virtually no contact occurs between adjacent cBN particles. The same thing may be said regarding the dispersion of the mixture of cBN and wBN because the sintered article of this invention has not only cBN but also wBN contained in the high-pressure phase boron nitride. The actual cutting is not only continuous but also interrupted. It is, therefore, necessary to find and use for the purpose of actual cutting the cBN and wBN content ratio which provides the optimum dispersion of these constituent. In the selection of the suitable ratio mentioned above, the fact that the two species of BN disperse in several different modes must be taken into consideration. If the content of the high-pressure phase boron nitride is less than 10% by volume, the salient characteristic manifested by the high-pressure phase boron nitride in the performance of the cutting tool cannot be fully realized. If this content exceeds 80% by volume, the high-pressure phase boron nitride reverts to its low-pressure phase and, therefore, sintered article is not usable for a cutting tool. Exceptionally for use in the general-purpose cutting tool, this content is desired to be in the range of 40 to 60% by volume.

Now, the method to be used for the production of the sintered article of this invention will be described.

The method of this invention requires the mixing to proceed so as to repress particularly the aggregation of wBN to the fullest possible extent. This method starts with mixing a binding phase of minute particles and wBN. In this case, since the wBN particles have a diameter not exceeding 1 μm, the particles of the binding phase are desired to be of uniform diameter.

In this case, the binding phase and the wBN are mixed in respective amounts calculated to give the following volumetric ratio.

20 to 90 parts by volume of the binding phase and [(100−the number of parts by volume of the binding phase mentioned above)×(0.001 to 0.05)] parts by volume of the wBN are mixed. Then, the mixture of the binding phase and the wBN prepared in advance as described above is regarded as if it were one homogeneous powder and is mixed with the cBN. In this case, the cBN is used in such an amount that the total amount of the binding phase, the wBN, and the cBN is 100 parts by volume.

The cBN particles are larger than the wBN particles and the particles of the binding phase. When they are mixed in a mixing vessel with the wBN particles and the particles of the binding phase which are smaller, the particles of smaller diameters are dispersed in a less satisfactory manner. The mixing step mentioned above may be carried out by known methods suitable for the particular particle diameters of the particles. The methods using a ball mill or a vibration mill, for example, are both usable for the purpose. Where two species of powder both having small particle diameters are to be mixed, the wet mixing method which uses an organic solvent containing no water is preferable.

This invention is able to provide a sintered article for cutting tools superior to the conventional sintered article in quality by the procedure which comprises homogeneously mixing the minute polycrystalline wBN particles with the binding phase and subsequently adding the cBN particles to the resultant mixture. The conventional sintered article has been short of fully harnessing the high hardness and high thermoconductivity inherent in the high-pressure phase boron nitride for the cutting tool. The present invention offers a perfect solution to this problem. Specifically, the wBN particles are homogeneously dispersed in the binding phase, thereby eliminating the problems regarding hardness and toughness.

A typical textural diagram of the sintered article of this invention based on a 1,500-magnification photomicrograph is illustrated in FIG. 1.

In the diagram, 1 stands for cBN, 2 for wBN, and 3 for a binding phase. This diagram depicts a texture in which the wBN particles are not aggregated but are uniformly dispersed in the binding phase and the cBN particles are likewise in a highly desirably dispersed state.

The sintered article of the high-pressure phase boron nitride produced by this invention for use in cutting tools acquires heretofore unattainable quality excelling in wearproofness and resistance to chipping by limiting the particle diameter of the easily aggregable minute wBN particles to a level below 1 μm, selecting the particle diameter of the cBN particles according to the nature of the continuation or intermittent cutting and combining the two selected particle diameters. Particularly, the success in enhancing both strength and toughness owing to the dispersion of the minute wBN particles in the binding phase allows elimination of the drawbacks inherent in the conventional binding phase.

Now, the present invention will be described more specifically below with reference to working examples and comparative experiments.

EXAMPLE 1

In a cemented carbide ball mill, 55% by volume of titanium carbide ($TiC_{0.65}$ having an average particle diameter of 1.8 μm), 15% by volume of titanium nitride ($TiN_{0.65}$ having an average particle diameter of 1.5 μm), and 30% by volume of aluminum (having an average particle diameter of 10 μm) were mixed in ethyl ether, treated to expel the ethyl ether, then pelletized, allowed to undergo reaction at 1,200° C. for 20 minutes, and pulverized into particles having an average particle diameter of 1.2 μm, to obtain a binding phase. In cemented carbide vibration mill pot, 97% by volume of this binding phase and 3% by volume of wBN particles having a diameter of not more than 1 μm were mixed in methanol, treated to expel the methanol, and filtered through a #325 mesh. The particles which passed the screen were used as a wBN mixture. In a cemented carbide ball mill, 45% by volume of the wBN mixture and 55% by volume of cBN particles having an average particle diameter of 3 μm were mixed in ethyl ether and then treated to expel the ether.

Figure 2:
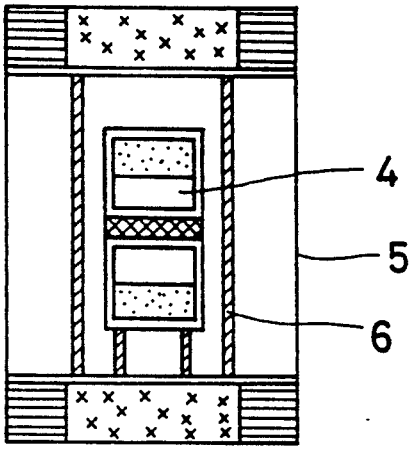
FIG. 2 is a diagram of a typical assembly for carrying out the sintering of this invention.
Figure 3:
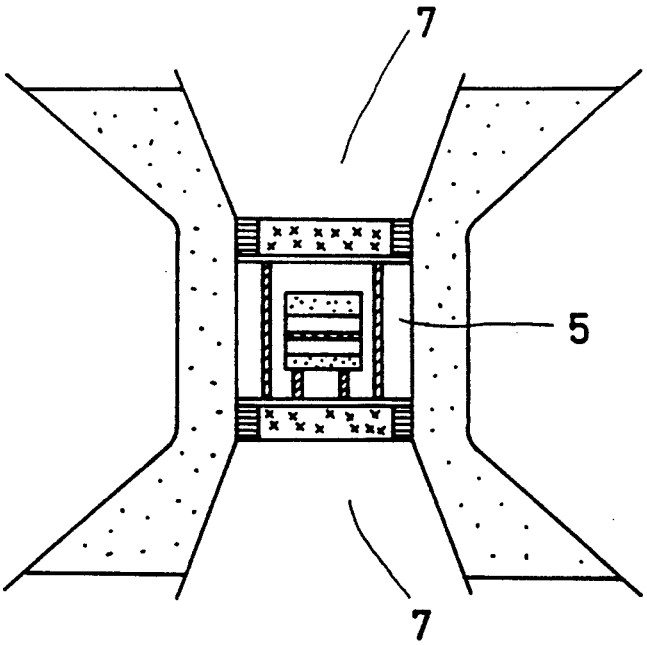
FIG. 3 is a diagram illustrating an example of an ultrahigh pressure generating part in an ultrahigh pressure apparatus used for the production of a sintered article of the present invention.

The resultant sample mixture was press molded in the shape of a disc 40 mm in diameter and 2 mm in thickness. Separately, 6% by weight of cemented carbide powder was press molded in the shape of a disc 40 mm in diameter and 3 mm in thickness. These discs were sealed in a capsule made of zirconium and having a wall thickness of 0.5 mm and set in place in an assembly 5 constructed as illustrated in FIG. 2. Here, 6 stands for a cylindrical heater. This assembly 5 was set in a belt type high-pressure device as illustrated in FIG. 3, compressed to a pressure of 48 Kb by advancing the vertically opposed anvil cores 7 toward each other and, at the same time, heated to a temperature of 1,530° C. by energizing a cylindrical heater 6, held under these conditions for 15 minutes and relieved of the heat and pressure, whereafter the capsule was recovered from the device. The disklike composite sintered article aimed at was obtained by scraping the zirconium plate from the capsule with a grindstone of silicon carbide.

The high-pressure phase boron nitride surface of this sintered article of the high-pressure phase boron nitride-hard metal had a Vickers hardness (under a load of 1 kg) of 3,200 kg/mm$^2$. This composite sintered article was cut into four sectors with an ultrasonic machine using diamond grinding particles having an average particle diameter of 5 μm at an output of 1 KW. One of the sectors was soldered to a cemented carbide substrate as a cutting tip, finished in the shape of SNMA 431, set in place on a prescribed commercially available clamp type holder, and subjected to a cutting test. In this test, a round bar of SKD 11 steel 40 mm in diameter heat-treated to a hardness of 55 on the Rockwell hardness C scale was used as a work blank and subjected to a dry cutting test under the conditions of 150 m/min. in peripheral speed, 0.5 mm in notch depth, and 0.1 mm/rev. in feeding speed. After the test had continued for 40 minutes, it was found that the cutting had produced a highly satisfactory cut surface on the work blank with a cutting tip flank wear width of 0.30 mm.

A separate similarly prepared composite sintered article was cut into six sectors by the same cutting method as described above. One of the sectors was soldered to a hard metal substrate as a cutting tip, finished in the shape of TNMA 331, set in place on a prescribed commercially available clamp type holder, and subjected to a cutting test. Specifically, the composite cutting tip was subjected to a dry interrupted cutting test with a work blank prepared by heat-treating a plate steel of SCM 420 (600 mm×200 mm×30 mm in thickness) to a hardness of 58 on the Rockwell hardness C scale under the conditions of 125 m/min. in peripheral speed, 0.5 mm in notch depth, and 0.1 mm/rev. in feeding speed. After 60 minutes' cutting, the cutting tip showed a flank wear width of 0.15 mm and produced a highly desirable cut surface on the work blank without sustaining a chipping.

EXAMPLE 2

Figure 4:
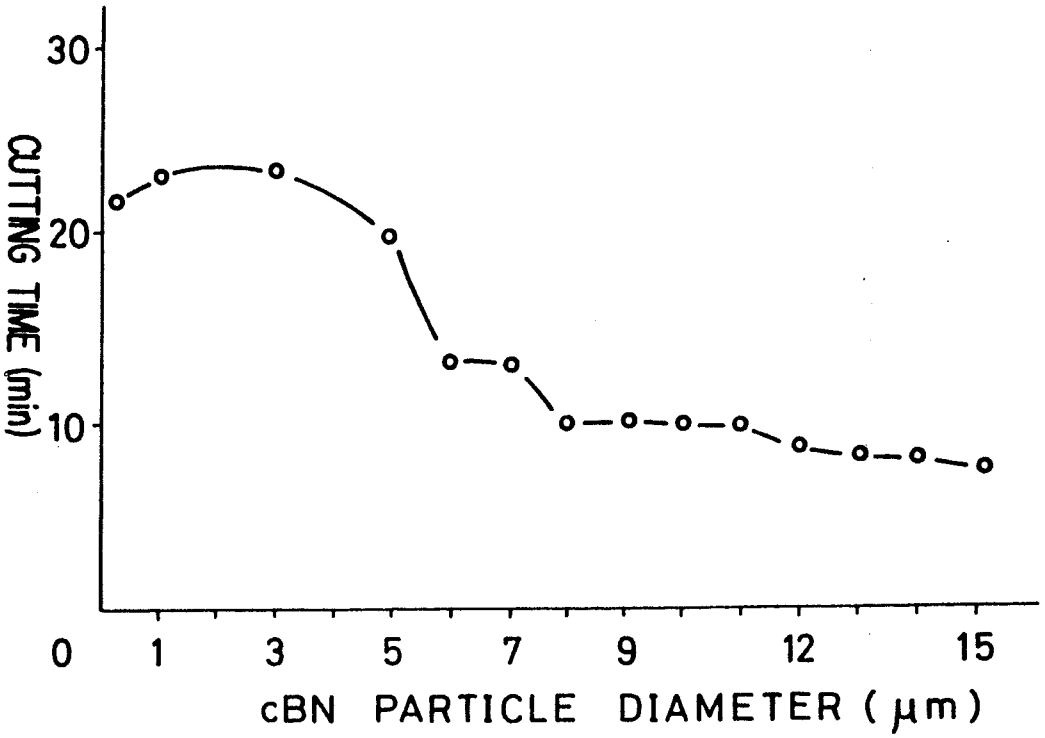
FIG. 4 is a diagram showing the results of a study performed on the effect of the diameter of cBN particles on wearproofness.

A binding phase was formed by combining 35% by volume of titanium carbide ($TiC_{0.73}$ having an average particle diameter of 3.0 μm), 30% by volume of tantalum carbide ($TaC_{0.98}$ having an average particle diameter of 1.5 μm), 20% by volume of aluminum (having an average particle diameter of 8 μm), and 15% by volume of silicon (having an average particle diameter of 1.2 μm). A sintered article was produced by mixing this binding phase with wBN and then mixing the resultant mixture with cBN in the same manner as in Example 1. In this example, samples obtained by continuously varying the particle diameter of cBN from 0.1 to 15 μm were subjected to the cutting test by following the procedure of Example 1. The test was continued to determine how long it took for the flank wear width to reach 0.20 mm (referred to as "cutting time"). The results are shown in FIG. 4. It will be noted from this diagram that the best results were obtained with the samples using cBN particles less than 5 μm in diameter.

EXAMPLE 3

Figure 5:
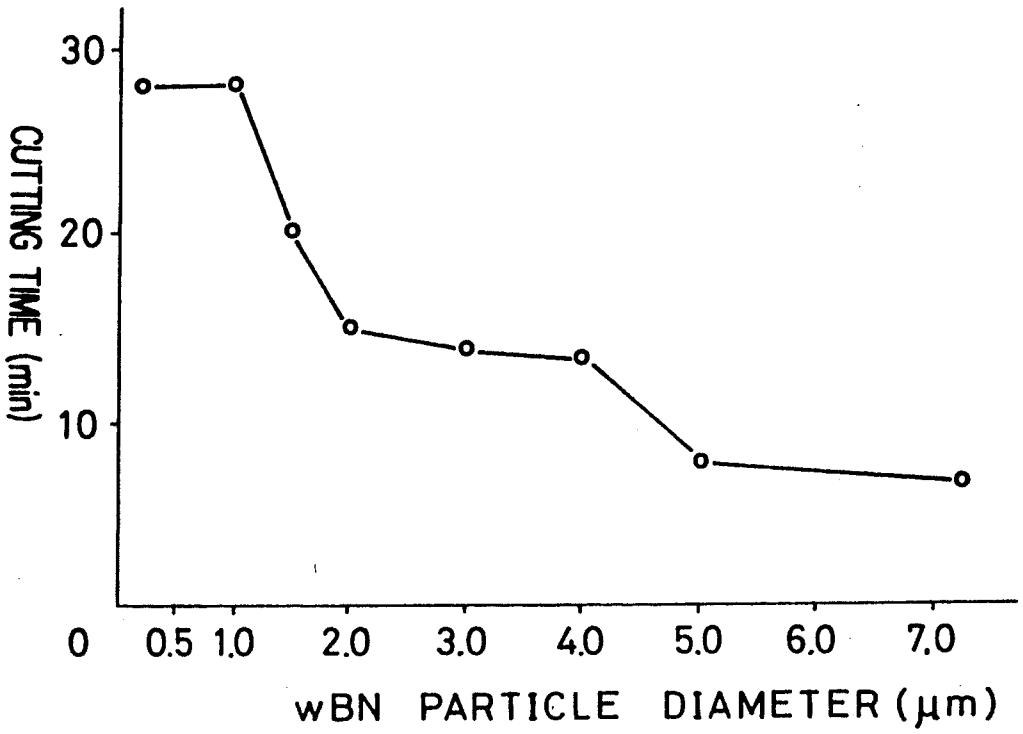
FIG. 5 and FIG. 6 are diagrams showing the effects of the diameter of wBN particles respectively on the resistance to chipping and the wearproofness.

Various sintered articles were produced by following the procedure of Example 1, except that the same binding phase as prepared in Example 2 was used instead and the particle diameter of the wBN was continuously varied from 0.1 to 7 μm. The various samples of sintered articles were subjected to a dry interrupted cutting test in the same manner as in Example 1 to find how long it took before they sustained chippings. The results are shown in FIG. 5, from which it will be noted that the best results were obtained when the particle diameters were below 1 μm.

EXAMPLE 4

Figure 6:
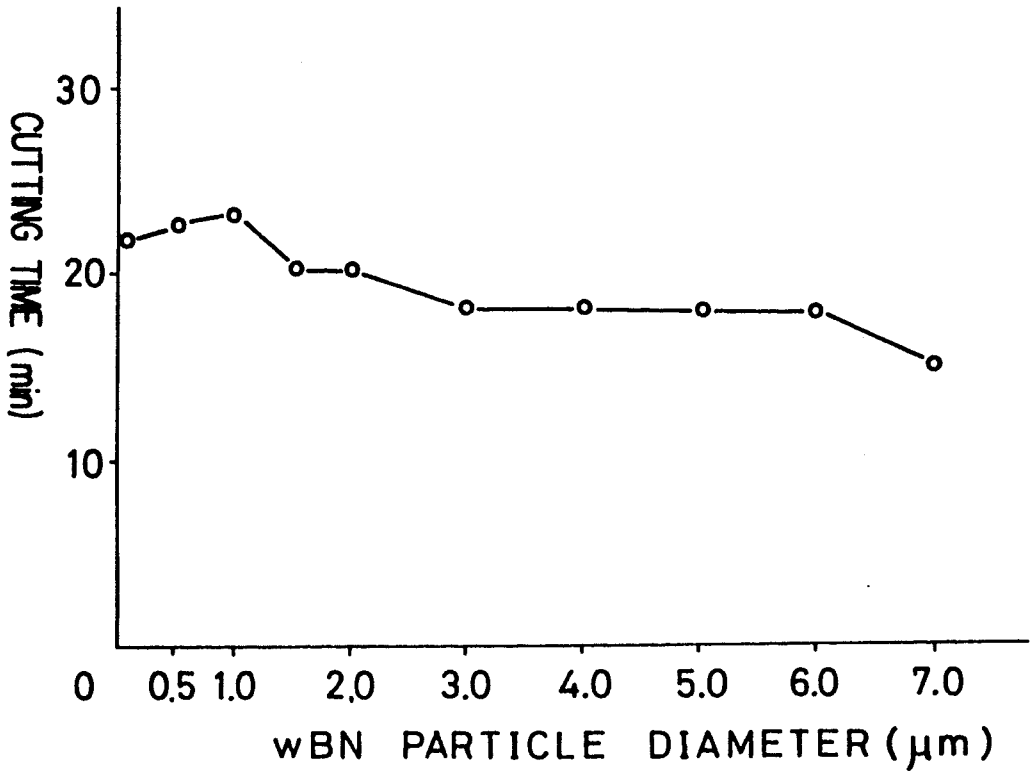

The same sintered articles as prepared in Example 3 were subjected to a continuous cutting test in the same manner as in Example 3. The results are shown in FIG. 6, from which it will be noted that the best results were obtained by the sample using wBN particles 1 μm in diameter, followed by the sample using wBN particles 0.5 μm in diameter.

EXAMPLE 5

Sintered articles were produced by following the procedure of Example 1, except that the cBN and wBN contents (% by volume) were varied. Cutting tips were similarly fabricated from the sintered articles and subjected to a cutting test. In the test, a round bar of SCM 440 steel (40 mm in diameter×600 mm in length) heat-treated to a hardness of 55 on the Rockwell hardness C scale was used as a work blank and subjected to a dry continuous cutting test under the conditions of 118 m/min. in peripheral speed, 0.4 mm in notch depth, and 0.1 mm/rev. in feeding speed to determine the how long it took for the flank wear width to reach 0.25 mm. The sample tips were subjected to a dry interrupted cutting test using as a work blank a SKD-11 plate steel (600 mm×200 mm×25 mm) heat-treated in advance to a hardness of 57 on the Rockwell hardness C scale and performed under the conditions of 155 m/min. in peripheral speed, 0.5 mm in notch depth, and 0.1 mm/rev. in feeding speed, to determine how long it took for the flank wear width to reach 0.1 mm.

Figure 7:
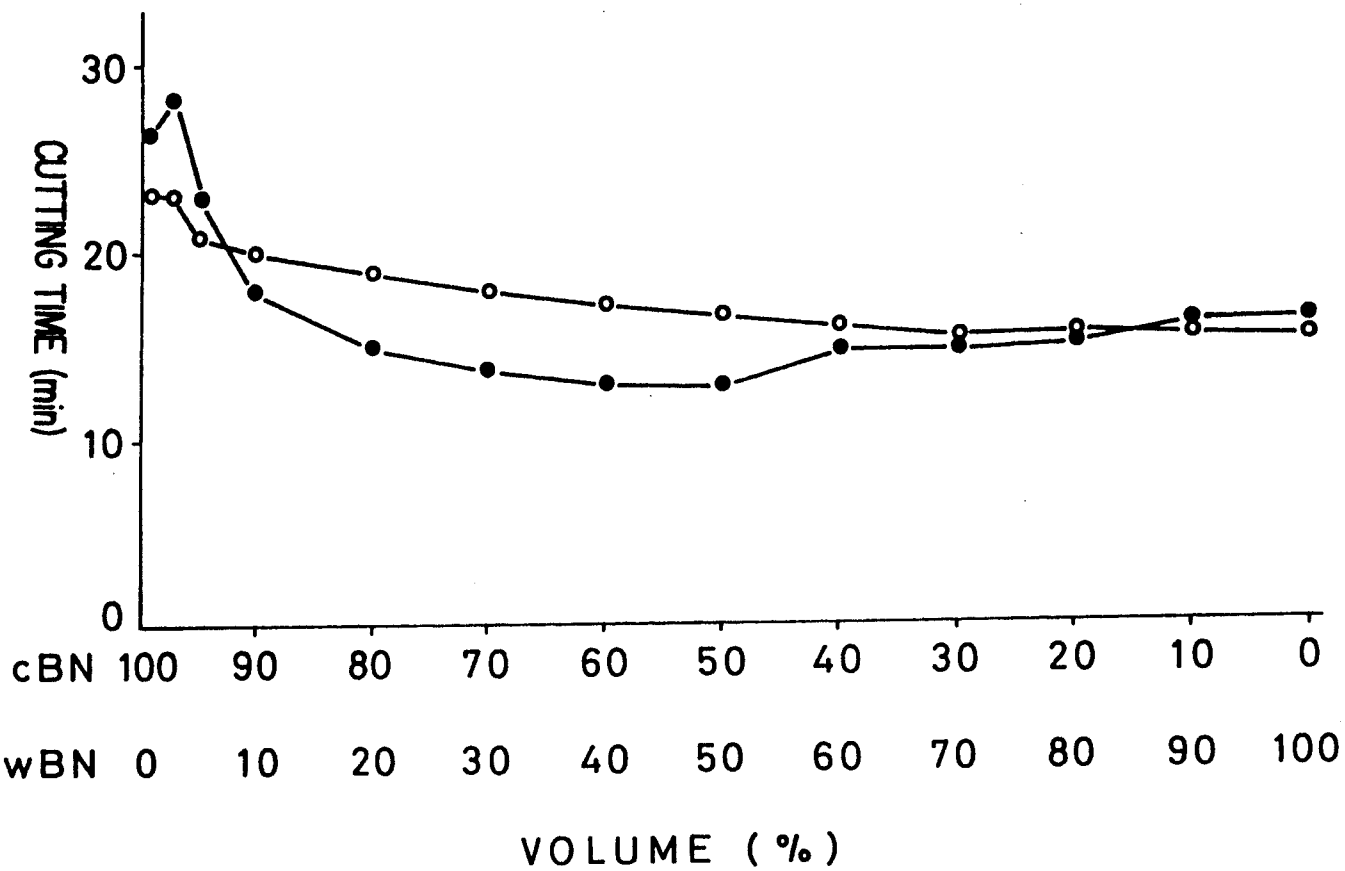
FIG. 7 is a diagram showing the effect of the amount of wBN in the high-pressure phase boron nitride on the cutting property.

It will be noted from the two sets of test results that the optimum wBN content was 3% by volume. The results are shown in FIG. 7. In the diagram, the solid circles (●) represent the data for the interrupted cutting test and the blank circles (○) the data of the continuous cutting test.

EXAMPLES 6 TO 9

Different composite sintered articles were obtained by following the procedure of Example 1, except that the composition of the components and the sintering conditions were varied as indicated in Table 1. The composite sintered articles were tested for Vickers hardness (under a load of 1 kg). The results are shown in Table 1.

The composite sintered articles were subjected to an ultrasonic cutting in the same manner as in Example 1 to produce similar cutting tips. These cutting tips were subjected to a dry continuous cutting test under the same conditions as used in Example 1 to determine the composite sintered articles' flank wear. The results are shown in Table 1.

TABLE 1

| | Example | | | | | | | |
|---|---|---|---|---|---|---|---|---|
| | 6 | | 7 | | 8 | | 9 | |
| BN cBN | 96 | 50 | 97 | 45 | 96.5 | 55 | 98 | 60 |
| wBN | 4 | | 3 | | 4.5 | | 2 | |
| Binding phase | | | | | | | | |
| Zirconium nitride | 10 | | — | | — | | 43 | |
| Vanadium nitride | — | | — | | 5 | | — | |
| Titanium nitride | 45 | | — | | 10 | | 15 | |
| Tantalum nitride | 15 | | 35 | | — | | — | |

TABLE 1-continued

| | Example | | | | | | | |
|---|---|---|---|---|---|---|---|---|
| | 6 | | 7 | | 8 | | 9 | |
| Zirconium carbide | — | 50 | — | 55 | 35 | 45 | — | 40 |
| Tungsten carbide | — | | 5 | | — | | 3 | |
| Titanium carbide | — | | 20 | | 4 | | 18 | |
| Zirconium boride | — | | — | | 16 | | — | |
| Titanium boride | 5 | | — | | — | | — | |
| Molybdenum boride | — | | — | | — | | 5 | |
| Metal | | | | | | | | |
| Nickel | 14 | | 15 | | — | | — | |
| Cobalt | 10 | | 10 | | — | | — | |
| Aluminum | — | | 15 | | 13 | | 15 | |
| Silicon | — | | — | | 2 | | — | |
| Zirconium | — | | — | | — | | 1 | |
| Tungsten | 1 | | — | | — | | — | |
| Production conditions | | | | | | | | |
| Pressure (Kb) | 40 | | 45 | | 47 | | 48 | |
| Temperature (°C.) | 1350 | | 1400 | | 1400 | | 1550 | |
| Time (min.) | 15 | | 15 | | 15 | | 15 | |
| Vickers hardness ($kg/mm^2$) of composite sintered article | 2970 | | 2980 | | 3010 | | 3070 | |
| Flank wear width (mm) after 40 minutes' cutting | 0.28 | | 0.31 | | 0.33 | | 0.29 | |

Note: The mixing ratio is indicated in % by volume. The righthand column under the heading of "Example" indicates the mixing ratio of the high-pressure phase boron nitride to the sum of the binding phase and the metal.

COMPARATIVE EXPERIMENT 1

The same binding phase, wBN, and cBN as produced in Example 1 were used in a cemented carbide ball mill, and these components in their inherently powdery form were mixed in ether. A tip produced by subjecting the resultant mixture to the same treatment was subjected to a dry continuous cutting test and a dry interrupted cutting test in the same manner as in Example 1. In the former test, the cutting tip showed a flank wear width of 0.40 and a serious crater wear after 25 minutes' cutting. In the latter test, the cutting tip sustained chipping after 30 minutes' cutting. The texture of the sintered article was found to have the high-pressure phase boron nitride, particularly wBN, dispersed therein in an inferior state.

COMPARATIVE EXPERIMENT 2

A sintered article was obtained in the same composition as in Example 1, except that the content of the high-pressure phase boron nitride was changed to 8% by volume. The Vickers hardness (under a load of 1 kg) of the high-pressure phase boron nitride surface of this sintered article was 2,050 $kg/mm^2$. When a cutting tip produced in the same manner as in Example 1 was subjected to the same cutting tests, it sustained chipping after 5 minutes' continuous cutting. It sustained chipping after 3 minutes' interrupted cutting.

COMPARATIVE EXPERIMENT 3

A sintered article was obtained in the same composition as in Example 1, except that the content of the high-pressure phase boron nitride was changed to 83% by volume. The Vickers hardness (under a load of 1 kg) of the high-pressure phase boron nitride surface of this sintered article was 1,900 $kg/mm^2$. In X-ray diffraction analysis, the sintered article showed signs of reversion of the high-pressure phase boron nitride to the low-pressure phase.

What is claimed is:

1. A sintered article of high-pressure phase boron nitride for use in cutting tool, which is produced by mixing wurtzite type boron nitride particles of a maximum diameter of 1 μm with an intermetallic compound formed between at least one inorganic compound selected from the group consisting of a) at least one compound of carbides, nitrides, and borides severally of the elements of Group 4*a* (Ti, Zr, and Hf), Group 5*a* (V, Nb, and Ta), and Group 6a (Cr, Mo, and W) in the Periodic Table of Elements and b) a mutual solid solution of said compounds and at least one metal selected from the group consisting of Al, Ni, Si, Co, Zr, and W, further mixing cubic boron nitride particles of a maximum diameter of 1 μm with the resultant mixture and sintering the produced mixture under a pressure of at least 20 Kb at a temperature of at least 1,000° C. and which comprises (1) 10 to 80% by volume of high-pressure phase boron nitride composed of 95 to 99.9% by volume of said cubic boron nitride and 0.1 to 5% by volume of wurtzite type boron nitride and (2) 20 to 90% by volume of intermetallic binding phase compound having said high-pressure phase boron nitride dispersed uniformly therein.

2. A sintered article according to claim 1, wherein the volumetric ratio of said inorganic compound and said metal in said intermetallic compound is in the range of 99.9:0.1 to 50:50.

3. A sintered article according to claim 1, wherein the volumetric ratio of said inorganic compound and said metal in said intermetallic compound is in the range of 95:5 to 60:40.

4. A sintered article of high-pressure phase boron nitride for use in cutting tool, which is produced by mixing wurtzite type boron nitride particles of a maximum diameter of 1 μm with an intermetallic compound formed between at least one inorganic compound selected from the group consisting of a) at least one compound of carbides, nitrides, and borides severally of the elements of Group 4*a* (Ti, Zr, and Hf), Group 5*a* (V, Nb, and Ta), and Group 6*a* (Cr, Mo, and W) in the Periodic Table of Elements and b) a mutual solid solution of said compounds and at least one metal selected from the group consisting of Al, Ni, Si, Co, Zr, and W, further mixing cubic boron nitride particles of a maximum diameter of 5 μm with the resultant mixture and sintering the produced mixture under a pressure of at least 20 Kb at a temperature of at least 1,000° C. and which comprises (1) 10 to 80% by volume of high-pressure phase boron nitride composed of 95 to 99.9% by volume of said cubic boron nitride and 0.1 to 5% by volume of wurtzite type boron nitride and (2) 20 to 90% by volume of intermetallic binding phase compound having said high-pressure phase boron nitride dispersed uniformly therein.

5. A sintered article according to claim 1, wherein said intermetallic compound is used in an amount in the range of 20 to 90 parts by volume, said wurtzite type boron nitride to be mixed with said intermetallic compound is used in an amount in the range of ((100−the number of parts by weight of said intermetallic compound)×(0.001 to 0.05)), and said cubic boron nitride to be added to the mixture of said intermetallic compound and said wurtzite type boron nitride is used in an amount to make up 100 parts by volume.

* * * * *

UNITED STATES PATENT AND TRADEMARK OFFICE

CERTIFICATE OF CORRECTION

PATENT NO. : 5,200,372

DATED : April 6, 1993

INVENTOR(S) : Yutaka Kuroyama et al.

It is certified that error appears in the above-identified patent and that said Letters Patent is hereby corrected as shown below:

On the title page, Item [75],

The second inventor's name is spelled incorrectly, should read as follows: --Masami Maeno--

Signed and Sealed this

Thirtieth Day of November, 1993

*Attest:*

*Attesting Officer*

BRUCE LEHMAN

*Commissioner of Patents and Trademarks*